US008757431B2

(12) United States Patent
Fodor

(10) Patent No.: US 8,757,431 B2
(45) Date of Patent: Jun. 24, 2014

(54) WIPE DISPENSER AND COLLECTOR UNIT

(76) Inventor: Andras Fodor, Budapest (HU)

( * ) Notice: Subject to any disclaimer, the term of this patent is extended or adjusted under 35 U.S.C. 154(b) by 138 days.

(21) Appl. No.: 13/142,384

(22) PCT Filed: Jan. 5, 2010

(86) PCT No.: PCT/HU2010/000002

§ 371 (c)(1),
(2), (4) Date: Jun. 30, 2011

(87) PCT Pub. No.: WO2010/079372

PCT Pub. Date: Jul. 15, 2010

(65) Prior Publication Data

US 2011/0266299 A1 Nov. 3, 2011

(30) Foreign Application Priority Data

Jan. 6, 2009 (HU) ..... 0900005

(51) Int. Cl.
*B65H 1/00* (2006.01)
*A47F 1/00* (2006.01)

(52) U.S. Cl.
USPC ..... 221/34; 221/102; 221/1; 221/45; 221/62; 221/304; 221/97; 221/98; 221/279; 221/33; 221/35; 221/44; 222/181.2; 312/42; 312/34.24; 312/37; 312/242; 248/231.9

(58) Field of Classification Search
CPC ..... A47F 1/00; B65H 1/00
USPC ..... 221/34, 102, 1, 45, 62, 304, 98, 279, 221/33, 35, 44, 97; 312/42, 34.24, 37, 242; 222/181.2; 248/231.9
See application file for complete search history.

(56) References Cited

U.S. PATENT DOCUMENTS

| | | | | |
|---|---|---|---|---|
| 1,688,242 | A * | 10/1928 | Lawrence et al. | 221/34 |
| 4,573,608 | A * | 3/1986 | Hansen | 221/92 |
| 4,706,845 | A * | 11/1987 | Schnurer et al. | 221/102 |
| 5,741,053 | A * | 4/1998 | Nielsen | 312/194 |
| 8,256,644 | B2 * | 9/2012 | Orgna | 221/45 |
| 2002/0113109 | A1 * | 8/2002 | Gracyalny et al. | 225/5 |
| 2010/0163569 | A1 * | 7/2010 | Parker | 221/1 |

OTHER PUBLICATIONS

International Search Report issues in PCT/HU2010/000002, dated May 11, 2010.

* cited by examiner

*Primary Examiner* — Gene O. Crawford
*Assistant Examiner* — Rakesh Kumar
(74) *Attorney, Agent, or Firm* — Handal & Morofsky LLC

(57) ABSTRACT

Wipe dispenser and collector unit particularly for use in gents' toilets, with a storage cabinet (2) for batches of wipes (24), with an aperture for the bottom wipe (24) located at the center of an angled bottom at an acute angle with the horizontal; the cabinet has a wall-mounting rear cover (3) and a front panel (5) connected to it that can be tilted forward in order to open it, with those two components forming the interior of the closed wipe storage cabinet (2), with a waste container at a specific distance underneath, which also has a wall-mounting rear cover (30), whose storage space, open at the top, is defined by the rear cover (30) and the front unit that can be tilted against it, with the bottom of the front unit connecting to the holes (14) at the bottom of the rear cover (30) with matching bolts (15), which can be released when the unit is tilted forward.

8 Claims, 3 Drawing Sheets

Figure 5:
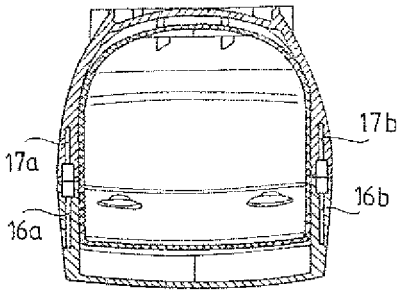

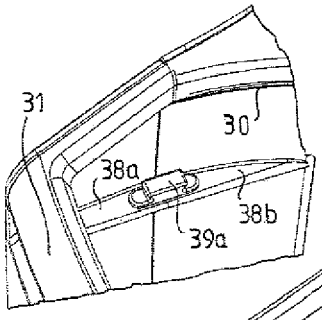
Fig. 9
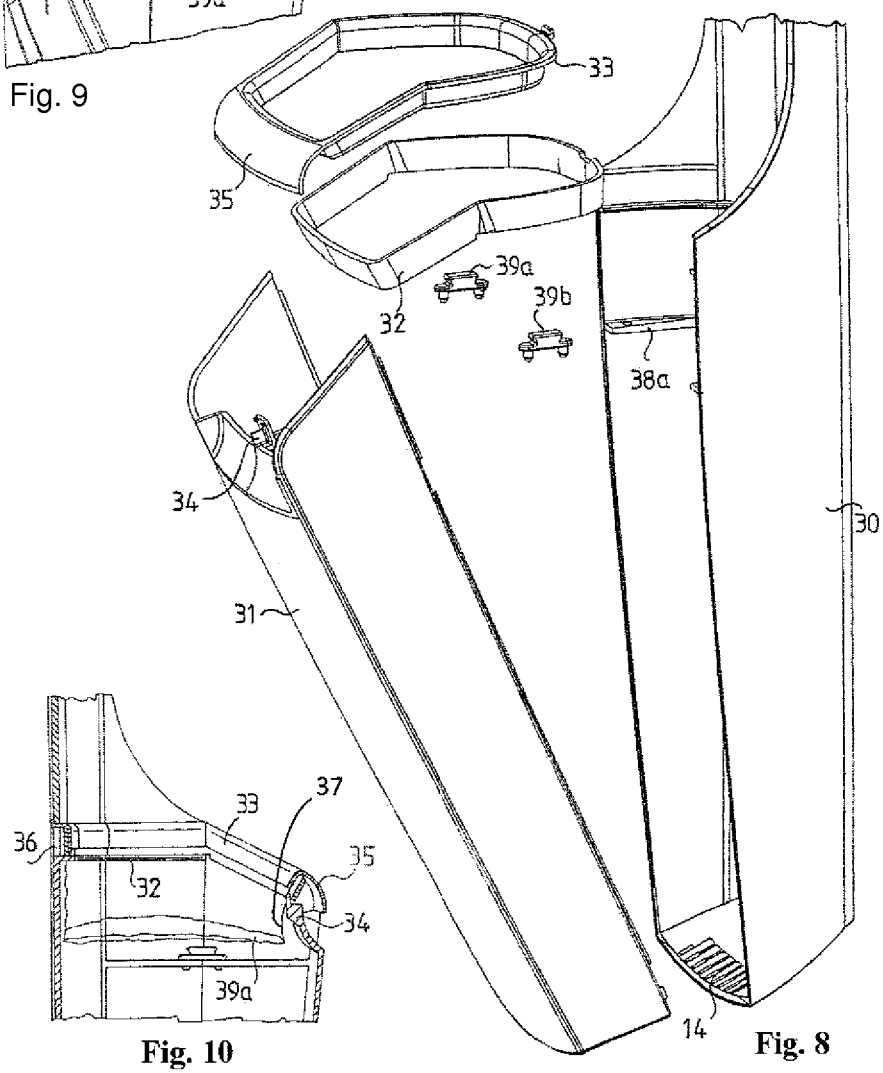
Fig. 8
Fig. 10

WIPE DISPENSER AND COLLECTOR UNIT

The invention relates to a wipe dispenser and collector unit, particularly for use in gents' toilets.

In gents' toilets there is a separate area where men can use the urinals. The urinals are installed with a specific spacing and the only other furnishings in general use are the partitions separating individual urinals and the sensors required for automatic flushing. Due to their size and design, the urinals are only suitable for liquids.

It is quite clearly the case that a hygienic wipe is or may be required after urination for men as well (particularly over a certain age). In a so-called water closet or at home, where all conditions are in place for wiping and disposing of the wipe, this is indeed easily done. Although even there, tearing off the paper may cause a bit of a problem after urination as at that point usually only one hand is free, and it is not easy to tear a piece of paper off a toilet roll with one hand while bending down.

Up until now, however, hygienic wiping in public gents' toilets has not been possible, primarily due to the lack of equipment facilitating it in line with the conditions there. In such toilets, the washbasins and the storage units for the dispensing and collection of paper towels for drying hands after washing them are in a separate room or area and their size and price renders them unsuitable for installation at the site of wiping. In order to facilitate hygienic use, the wipes and the collection box must be located in the direct vicinity of men using the urinals, within arm's reach, but the collection container may not be placed on the floor because easy, unhindered mopping in that area is a must. In order to meet requirements, a solution has to be found that allows a sheet of paper of appropriate size and quality to be taken from a dispenser with a single move of one hand after using the urinal without having to step away from it, and also allows the used wipe to be thrown in a bin in the same position.

In toilets aboard aircraft, where space is severely limited, single units containing both a wipe dispenser and a waste container have already been used, as seen in U.S. Pat. Nos. 4,887,767 and 6,938,284, for instance. But such compact devices could not be used for the above-mentioned purpose, in the direct vicinity of urinals, due to the amount of space they require, among other things.

The patent application DE 10237145 A1 describes a wipe storage cabinet in a single unit with a stand that has several ergonomic and hygienic shortcomings, namely that a single movement of one hand is not sufficient to obtain a wipe, but rather it has to be taken from a covered location, and when it is thrown away, it is placed in a non-hygienic container. The solution does not describe how the discarded wipes can be removed in a hygienic and fast manner from the storage container.

Patent application US 2005/0173285 A1 describes a wall-mounted paper dispensing and collecting unit, but that uses normal toilet paper and a much wider open waste container with an open top. That solution is unsuitable for the application described in the introduction for several reasons, the most important of which are the large width, the resulting horizontal space requirement and the large opening of the waste container, which is a hygiene problem.

U.S. Pat. No. 1,688,242 describes a collection and dispenser stand for paper towels whose dispenser unit has a centred dispensing aperture at the bottom and whose waste container has an open aperture through which the used towels drop into an open plastic liner. The size of the solution is consistent with the size of paper towels, it is wide and the fast and hygienic replacement of liners is not provided for.

U.S. Pat. No. 4,706,845 describes a nappy storage cabinet with a used nappy collection container underneath for babies. The top and bottom part of the device are not separated, taking a nappy out is relatively difficult and cumbersome while in order to dispose of a used nappy the collector box has to be tilted outwards from its upright closed position, which grants access to the opening at the top. So both hands are needed in order to dispose of a nappy. In view of that, the solution is also unsuitable for male hygienic wipes.

The objective of the present invention is to design a dispenser and waste collector stand that is particularly suitable for use with urinals and takes into account the special conditions described above that obtain in such settings, but which has an aesthetic appearance, is easy to clean and can be produced at an acceptable cost.

To meet the above objective the wipe dispenser and collector unit has been provided which has been designed as defined by the attached claims.

Figure 4:
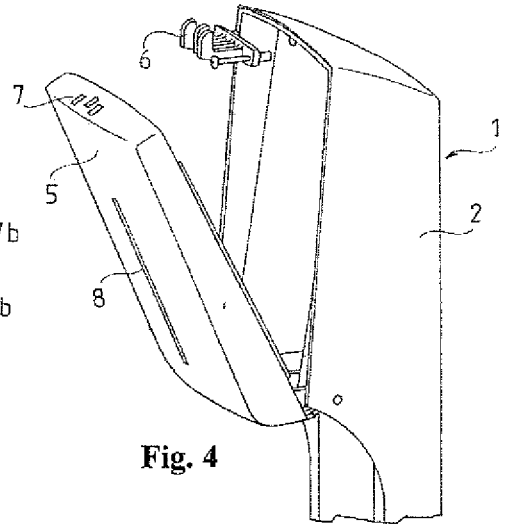
Figure 1:
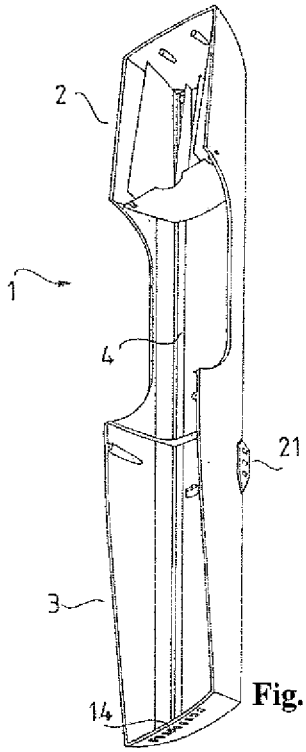
Figure 2:
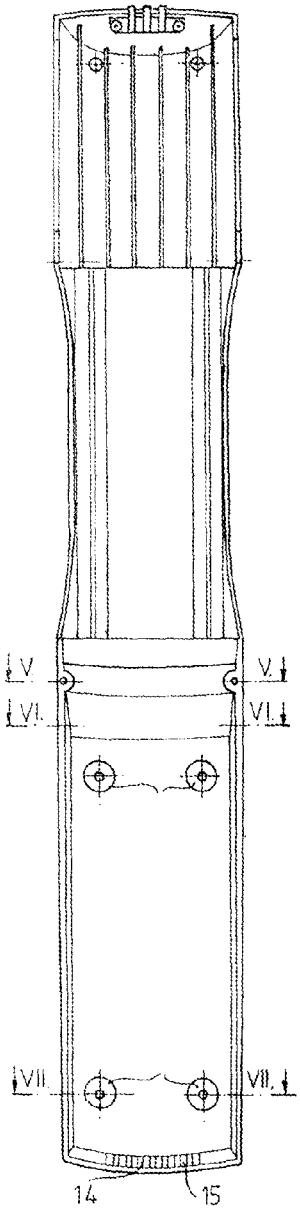
Figure 3:
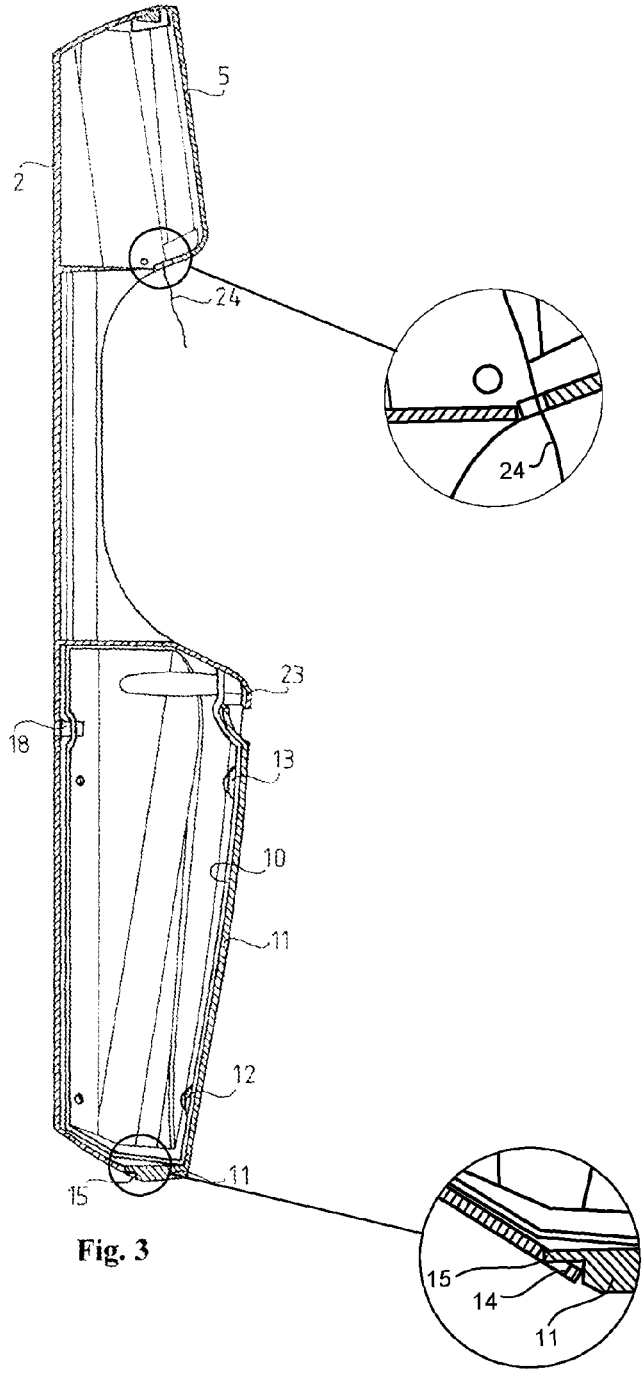

The wipe dispenser and collector unit according to the present invention will now be described in connection with preferable embodiments thereof, wherein reference will be made to the accompanying drawings. In the drawings:

FIG. 1 is the perspective view of the integrated rear casing for cabinet and waste container FIG. 2 shows the front cross-section view of the unit FIG. 3 is the side cross-section view of the unit FIG. 4 is the perspective view of the top cabinet with front panel open FIG. 5 is a cross-section taken along line V-V in FIG. 2

Figure 6:
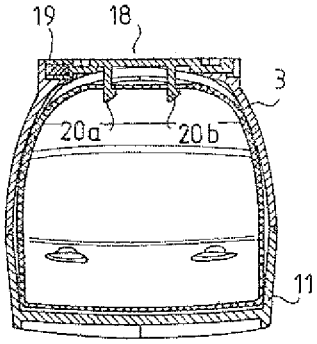

FIG. 6. is a cross-section taken along line VI-VI in FIG. 2

Figure 7:
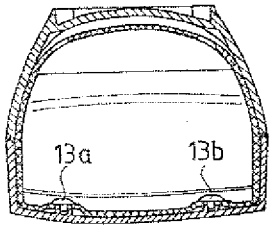

FIG. 7 is a cross-section taken along line VII-VII in FIG. 2

FIG. 8 is a perspective view of the second design for the waste container open, partially exploded FIG. 9 shows the waste container in closed sate, in a perspective view FIG. 10 is a side cross-section view showing the assembly of liner holder frame, closing frame and adjoining components The perspective view of FIG. 1 shows the wall-mounting stationary component 1 of the wipe dispenser and waste container unit that is the subject of the invention. It is a narrow, tall shell shape that forms the rear of the unit, best made out of a single piece of injection moulded plastic. The stationary component 1 is a curved, designer item with three main parts. At the top, there is the rear of the wipe storage and dispenser container 2, the rear section of the waste container for used wipes 3 is at the bottom while there is a connecting piece 4 in the middle whose visible front surface can be used for the placement of advertising or other signs. The cabinet 2 is for storing and dispensing the wipes that are not shown in the drawing, the interior, which is open at the front, is closed by a downward tilting front panel 5 connected to the rear wall of the cabinet 2 as shown in FIG. 4. The front panel 5 can be closed by tilting back up, when the bolts 6 shown near the top of FIG. 4 and attached to the wall of the cabinet 2 lock into the holes 7 in the narrow top of the front panel 5 and keep it in the locked position. Opening requires a special tool not shown in the drawing which is shaped like a three-pronged fork, whose prongs can be inserted in the holes 7 so as to press the bolts 6 slightly down, until they disengage from the holes 7, allowing the front panel 5 to be opened again. The quantity of wipes in the cabinet 2 can be seen through the narrow vertical window 8 down the centre line of the front panel 5.

The waste container is a narrow, deep box that may be open at the top or may have a removable cover. which may have a variety of internal layouts. In the case of the first design shown FIGS. 2 and 3 and the accompanying cross-sections shown in FIGS. 5-7 there is a waste container box 10 that constitutes a separate mechanical unit and which can be connected to the stationary component with a simple movement, whose shape is shown from the side by the thick line in the cross-section shown in FIG. 3. The cross-section shown in FIG. 2 cuts across the material of the waste container 10, indicated by the hatched area. Essentially, the waste container 10 fits fully into the surrounding niche in the stationary component 1, i.e. the rear casing 3. The connection is clearly visible in the cross-sections shown in FIGS. 5-7. The front of the waste container 10 has a sealing apron 11 attached to it as a visible cover, and in the operational position, the sealing apron 11 is connected to the rear cover 3 of the stationary component 1, forming a sealed cover together.

The sealing apron 11 is attached to the front wall of the waste container 10 using the hidden connectors 12 and 13 shown in FIG. 3, whose design is shown in the cross-section in FIG. 7. Connector 13 is included in both sides. Connector 13*a* on the left side and connector 13*b* on the right side are identical, preferably consisting of a plastic bolt and a locking eye with a release mechanism. During normal use, the sealing apron 11 and the waste container 10 do not need to be disassembled.

The very bottom of the stationary component 1 is angled with comb-shaped apertures 14. The bottom of the sealing apron 11 has hooked bolts extending from it 15, which fit into the apertures 14 and around whose ends the waste container 10 and the sealing apron 11, which form a single mechanical structure, can be attached to the rear cover 3. This connection interconnects to two halves of the casing seamlessly, but if the container is tilted forward, the link can be disengaged by moving the waste container upwards at an angle.

The two interlocked halves of the cover are fixed at the top partly using a magnetic connector and partly using bolts. FIG. 5 is a cross-section taken in the plane of the magnetic locking mechanism. The front and rear edges of the rear cover 3 and the sealing apron 11 respectively (i.e. the sides that are in contact) are thick enough to accommodate two pairs of magnets, 16*a* and 16*b* and 17*a* and 17*b*, whose surface is level with the surface of the accommodating edges and which meet to connect to two adjoining edges with a certain amount of (releasable) force.

The seamless connection of the waste container 10 to the rear cover 3 is shown in the cross-section in FIG. 6.

The flat rear wall of the rear cover 3, which is adjacent to the wall, has a cavity in it for a sideways slide 18 that is spring loaded 19, with two bolts, 19*a* and 19*b* extending to the front from it, with sideways tips. The rear wall of the waste container 10 has holes to match the bolts 19*a* and 19*b*, which the hooks of bolts 19*a* and 19*b* catch in when the waste container 10 is tilted all the way back. At the end of the slide 18 opposite the spring 19 the rear cover 3 has three holes 21 in its side wall (shown together in FIG. 1 as well). The shapes and spacing of the holes 21 are identical to the holes 7 at the top of the front panel 5 of the cabinet 2, so they admit the same, three-pronged tool, allowing the slide 18 to be shifted sideways, against the spring 19. The available movement is sufficient to unhook the bolts 20*a* and 20*b* from the holes in the rear wall, and after that the waste container 10 can be tilted forwards if sufficient force is applied (to counteract the magnetic bolts).

The rear wall of the stationary component 1 is largely in a single plane, it is flush with the wall and is attached using screws. Those go through the holes included in the rear wall for this purpose 22.

The lip 23 along the front section of the top edge of the waste container 10, as shown in the side view in FIG. 3, makes it significantly easier to install and remove it. Under that lip 23, the front wall of the waste container 10 and the sealing apron 11 are both recessed to provide room for grabbing the lip by hand.

The first specific design of the dispenser and collector unit that is the subject of the invention is very easy to use. The unit can be installed in gents' toilets in the space between urinals, preferably to the right of each urinal so that the top opening of the waste container is between thigh and hand height, which makes throwing the used wipe in as comfortable as possible, without having to shift position. Scale drawings of the stationary component are shown in FIGS. 2 and 3, the greatest width is between 150 and 180 mm, therefore it does not require much space in the sideways direction. The depth of the unit is similar or less, so the dispenser and collector unit is not a nuisance and it may even serve as a partition from the next urinal.

The paper wipes to be used are similarly small, width between 90-120 mm, depth 50-70 mm. The cabinet 2 can store a large number of flat, interlocking wipes, the end of the bottom wipe 24 extends forward and down through the aperture in the angled bottom of the cabinet 2 (FIG. 3). This design makes it easy to take out wipes. After wiping, the used wipe can be dropped in the waste container with a single comfortable movement. The interior of the container is angled, used wipes drop in easily.

The waste container 10 may only be emptied by staff as only they possess the tool required for opening the bolts 20*a* and *b*. After the bolts are undone, the waste container 10 can be tilted forward, then removed sideways from the bottom of the rear cover 3 together with the sealing apron 11 with an angled upward movement. Then it is simple to empty the container and a cleaning implement of suitable size and shape (e.g. brush or omnidirectional spraying nozzle) can be used to clean and disinfect it.

FIGS. 8-10 show a second specific design whose top cabinet 2 and general layout is identical to the first one, the difference being that instead of the permanent waste container, this one uses a disposable plastic liner made of thin foil like those in general household use that fits into the deep waste container.

In this version, the rear cover 30 has a slightly different design, but the holes at the bottom 14 are the same. The function of the sealing apron 11 is taken over by a sealing apron 31 designed as a self-supporting front panel which has the bolts that fit into the holes 14 at the bottom (although they are not shown in the drawing) as in the previous design, i.e. the sealing apron 31 can be tilted up and down, removed and replaced in a similar manner.

FIG. 8 shows the sealing apron 31 in a tilted down (open) position, and shows the specific liner holder frame 32 at the, which has a fitting sealing frame 33. The interior of the rear cover 30 is such that the sealing frame 33 and the liner holder frame 32 are supported by interior lips from underneath. FIG. 8 shows that at the top of the sealing apron 31 at the front there is a suitable recessed part that allows the liner holder 32 and the sealing frame 33 to be removed and replaced with a single movement of the hand without opening the sealing apron 31. The lip 35 is big enough to cover the liner holder 32 underneath it. The interior of the rear cover 30 has the rear bolt 36 shown in FIG. 10, which catches the rear edge of the liner holder frame 32 when it is tilted up, but when moved upwards at an angle, the mechanism releases automatically. The rear end of the sealing frame 33 lies atop the locked rear edge of the liner holder frame 32 and cannot be pulled out to the front.

So, in order to use the waste container, a liner 37 of appropriate shape and size, only sketched in FIG. 10, is pulled onto the liner holder frame, folding the top edge back a little. This is essentially the manner in which all bin liners are installed. The liner holder frame 32 and the liner 37 are placed together onto the top of the supporting lip at the top of the two-part waste container that is closed, so that the rear edge catches on the bolt at the rear 36, then, tilting down to a horizontal position, the front edge connects with bolt 34 and the liner holder frame 32 is fixed in place. After that, the sealing frame is put in place over and around the liner holder frame with a similar angled tilting movement and when the horizontal position is reached, the whole assembly locks in place. Removal for replacement of the liner 37 is performed in the opposite order. This is very simple and can be done with one hand. The lip 35 does not only have an aesthetic role, it also makes it simpler to remove the sealing frame 33. The sealing frame 33 is large enough to provide space for the folded back edge of the liner between itself and the liner holder frame that it surrounds.

FIG. 9 shows a sketch of the connection of the sealing apron 31 to the rear cover 30. Both connector units have a horizontal support surface 38*a*, 38*b* at the top, on the sides. Those surfaces accommodate a locking component each 39*a*, 39*b*, so that the horizontal bottom surfaces of the locking components 39*a* and 39*b* have two bolts each extending down, one of which fits in the hole in the edge 38*a* of the sealing apron 31, while the other fits into the hole in the edge of the rear cover 38*b*. As such, the locking components connect the two halves of the waste container at the top. At the bottom, we see the releasing connecting mechanism described for the previous design. The linked halves of the waste container do not need to be disassembled every time the liner is replaced, this is only required when the entire unit is installed or removed, or when disinfection is performed.

In view of the fact that the liner 37 is relatively small in cross-section and very deep, after installation it has to be opened up and smoothed against the internal wall of the waste container by hand or using a manual implement. If required in order to prevent the liner going flat, flexible internal tensioning ribs, i.e. C-shaped pieces or springs may also be used.

The advantage of using the unit that is the subject of the invention is that taking and disposing of a wipe can be performed with a single hand movement, without the user having to shift position, while the unit also serves as a partition, it is hygienic and can be placed without causing any hindrance thanks to its small dimensions. The bottom of the waste container of the unit is 20 to 30 cm from the floor so it does not hinder mopping, while the top opening is between thigh and hip height for men of average height, while the bottom of the cabinet 2 is at elbow height. This placement makes using the unit the most comfortable. For aesthetic and cost-saving purposes it is advantageous to have the cabinet and the waste collector in an integrated rear cover, but as far as use is concerned, the middle, connecting section can be left out.

It should be mentioned that the invention can also be used for other purposes as well, primarily in healthcare institutions, in all locations, where relatively small amounts of liquid need to be wiped up on a regular basis, possibly with selective collection of the waste generated. Its aesthetic design, its appearance, which may be adapted to the surrounding colour scheme, and its easy operation make it suitable for a wide range of applications.

The invention claimed is:

1. Wipe dispenser and collector unit particularly for use in gents' toilets, comprising a storage cabinet for batches of wipes, wherein said storage cabinet has a wall-mounted rear cover and a front panel connected to said rear cover to define a substantially closed storage space, said front panel is hinged to said rear cover and can be tilted forward and downward to open said storage space, said rear cover and front panel define a gap at their bottom for the release of the lowermost one of said wipes, said unit comprises a waste container positioned a predetermined distance under said storage cabinet, said waste container comprising a wall-mounting lower rear cover, and a front unit that can be tilted against said lower rear cover, and said waste container having a closed state when said lower rear cover and said front unit are attached to each other, said lower rear cover and said front unit defining a waste storage space open at the top, said lower rear cover comprising a rear wall, a pair of spaced curved side walls with forward facing edges and a rear bottom part constituting together a hollow rear body open in a front direction, said front unit of said waste container comprising a front wall, two front side walls, with rearward facing edges and a front bottom part constituting together an integrated hollow front body open in a rear direction, and in said closed state said front side walls and said front bottom part of the front body contact said curved side walls and said rear bottom part of said lower rear cover along said edges; said front and rear bottom parts comprise hooked bolts and respective mating comb-like holes that form a hinge for said front body, said hinge allowing for said front body to be tilted forward and to partially open said waste storage space and said hinge connection between said hooked bolts and comb-like holes allowing release of said front unit when said front unit is tilted forward, and in said closed state said front unit and said lower rear cover are additionally connected to each other at a higher position by means of releasable connection elements, and said waste storage space of said waste container open at the top remaining fully open from the beginning of said tilting movement till the fully open position without having any element that would partially cover said opening; a separate container open at the top and closed from all other sides, said storage container being inserted in said waste storage space, said storage container being connected to said front wall of said front unit by hidden connection elements being tilted together with said front unit.

2. The dispenser and collector unit as claimed in claim 1, wherein the releasable connection provided between an upper region of said rear wall of said lower rear cover and a rear wall of said storage container comprises a lateral slide with two ends, said slide being biased at a first end in a lateral direction with a spring, said slide comprising forwardly extending bolts with lateral hooks, and said rear wall of said waste container comprises holes in location corresponding to said bolts, said bolts engaging said holes, said rear wall of said lower rear cover defining a number of lateral holes arranged in a predetermined geometric pattern, and the second end of said slide extends to the interior of said patterned holes, whereby said slide can be pushed in a lateral direction by using a tool designed according to said pattern and inserted from an outward direction in said holes, and said lateral sliding movement of said slide releases said bolts from said holes in the rear wall of said waste container so that said waste container can be tilted forward together with said front unit.

3. The dispenser and collector unit as claimed in claim 1, comprising a forward lip made in an upper front region of said front wall of said front unit, said lip extending in an outward and a downward direction defining a recess, allowing the gripping of said front unit by hand.

4. The dispenser and collector unite as claimed in claim 1, wherein said releasable upper connection between said edges of said side walls of said front unit and said lower rear cover comprise magnetic bolts embedded in said side walls in mutually opposite positions.

5. Wipe dispenser and collector unit particularly for use in gents' toilets, comprising a storage cabinet for batches of wipes, wherein said storage cabinet has a wall-mounted rear cover and a front panel connected to said rear cover to define a substantially closed storage space, said front panel is hinged to said rear cover and can be tilted forward and downward to open said storage space, said rear cover and front panel define a gap at their bottom for the release of the lowermost one of said wipes, said unit comprises a waste container positioned a predetermined distance under said storage cabinet, said waste container comprising a wall-mounting lower rear cover, and a front unit that can be tilted against said lower rear cover, and said waste container having a closed state when said lower rear cover and said front unit are attached to each other, said lower rear cover and said front unit defining a waste storage space open at the top, said lower rear cover comprising a rear wall, a pair of spaced curved side walls with forward facing edges and a rear bottom part constituting together a hollow rear body open in a front direction, said front unit of said waste container comprising a front wall, two front side walls, with rearward facing edges and a front bottom part constituting together an integrated hollow front body open in a rear direction, and in said closed state said front side walls and said front bottom part of the front body contact said curved side walls and said rear bottom part of said lower rear cover along said edges; said front and rear bottom parts comprise hooked bolts and respective mating comb-like holes that form a hinge for said front body, said hinge allowing for said front body to be tilted forward and to partially open said waste storage space and said hinge connection between said hooked bolts and comb-like holes allowing release of said front unit when said front unit is tilted forward, and in said closed state said front unit and said lower rear cover are additionally connected to each other at a higher position by means of releasable connection elements, and said waste storage space of said waste container open at the top remaining fully open from the beginning of said tilting movement till the fully open position without having any element that would partially cover said opening; a removable liner holder frame and a locking frame that can be placed in a releasable manner on each other and on upper edges of said waste container, and a waste collecting liner is attached to said liner holder frame, said liner extending in said cavity of said waste container.

6. The dispenser and collector unit as claimed in claim 5, wherein at an upper end portion of said front unit a supporting recess is defined for receiving and supporting said liner holder frame, and an upper end portion of said rear body of said lower rear cover comprises a lip to hold and support a rear part of said liner holder frame, said frame being kept in position by a first bolt extending upwards from the front part o said upper edge of said front wall of said front unit and by means of another rear bolt extending in forward direction from an upper rear part of said lower rear cover so that said liner holder frame can be removed by an upwardly tilting and slightly upwardly pulling movement.

7. The dispenser and collector unit as claimed in claim 6, wherein a sealing frame is placed over said liner holder frame such that said sealing frame covers said liner holder frame, and said sealing frame comprises at the front end a downwardly extending lip.

8. The dispenser and collector unit as claimed in claim 5, wherein said releasable connection between said front unit and said lower rear cover comprises thin ledges with flushing upper faces when said front unit and lower rear cover are attached to each other and said ledges are interconnected by releasable locking components.

* * * * *